US006948199B2

(12) United States Patent
Hooper, Jr.

(10) Patent No.: US 6,948,199 B2
(45) Date of Patent: Sep. 27, 2005

(54) BED FOUNDATION

(75) Inventor: William W. Hooper, Jr., Anderson, SC (US)

(73) Assignee: Global Advanced Systems, LLC, New York, NY (US)

( * ) Notice: Subject to any disclaimer, the term of this patent is extended or adjusted under 35 U.S.C. 154(b) by 0 days.

(21) Appl. No.: 10/635,973

(22) Filed: Aug. 7, 2003

(65) Prior Publication Data

US 2005/0028274 A1 Feb. 10, 2005

(51) Int. Cl.[7] ..... A47C 19/00; A47C 19/02

(52) U.S. Cl. ..... 5/200.1; 5/53.1; 5/201; 5/400

(58) Field of Search ..... 5/400, 200.1, 201, 5/53.1, 310

(56) References Cited

U.S. PATENT DOCUMENTS

| | | | | | |
|---|---|---|---|---|---|
| 2,924,830 | A | * | 2/1960 | De Long | 5/8 |
| 3,049,729 | A | * | 8/1962 | Broyles | 5/200.1 |
| 3,249,953 | A | * | 5/1966 | Leskin et al. | 5/285 |
| 3,656,193 | A | * | 4/1972 | Schneider et al. | 5/308 |
| 3,935,605 | A | | 2/1976 | Hutchinson | |
| 3,950,797 | A | | 4/1976 | Bronstien, Jr. | |
| 3,957,239 | A | | 5/1976 | Slaats et al. | |
| 4,065,818 | A | | 1/1978 | Farina | |
| 4,106,139 | A | | 8/1978 | Southard | |
| 4,181,991 | A | | 1/1980 | Morgan et al. | |
| 4,319,370 | A | * | 3/1982 | Robinson | 5/201 |
| 4,734,946 | A | | 4/1988 | Saputo | |
| 4,774,733 | A | | 10/1988 | Akers | |
| 5,144,706 | A | | 9/1992 | Walker | |
| 5,303,438 | A | | 4/1994 | Walker | |
| 5,469,589 | A | | 11/1995 | Steed et al. | |
| 5,490,292 | A | | 2/1996 | Auburn | |
| 5,564,140 | A | | 10/1996 | Shoenhair et al. | |
| 5,664,273 | A | * | 9/1997 | Obriot | 5/724 |
| 5,953,775 | A | | 9/1999 | Mauro et al. | |
| 6,108,834 | A | | 8/2000 | Mauro et al. | |
| 6,338,172 | B1 | | 1/2002 | Taylor et al. | |
| 6,449,786 | B1 | | 9/2002 | Voit | |
| 6,481,033 | B2 | | 11/2002 | Fogel | |
| 6,615,425 | B1 | | 9/2003 | Candell | |
| 2002/0029425 | A1 | | 3/2002 | Henley et al. | |
| 2002/0059681 | A1 | | 5/2002 | Gladney et al. | |
| 2002/0069462 | A1 | | 6/2002 | Gaboury et al. | |
| 2002/0112291 | A1 | | 8/2002 | Barman et al. | |
| 2002/0133880 | A1 | | 9/2002 | Schuster | |
| 2002/0133883 | A1 | | 9/2002 | Perez et al. | |
| 2002/0148043 | A1 | | 10/2002 | Le Duc et al. | |
| 2002/0148045 | A1 | | 10/2002 | Giori et al. | |
| 2003/0009831 | A1 | | 1/2003 | Giori et al. | |
| 2003/0028963 | A1 | | 2/2003 | McCraw et al. | |
| 2003/0079284 | A1 | | 5/2003 | Gaboury et al. | |
| 2004/0049847 | A1 | | 3/2004 | Leoutsakos | |
| 2004/0078897 | A1 | * | 4/2004 | Gladney | 5/400 |

FOREIGN PATENT DOCUMENTS

| | | |
|---|---|---|
| DE | 1930227 | * 12/1970 |
| WO | WO 99/15051 | 4/1999 |
| WO | WO 03/086151 | 10/2003 |

* cited by examiner

*Primary Examiner*—Alexander Grosz
(74) *Attorney, Agent, or Firm*—Gordon & Rees LLP

(57) ABSTRACT

A bed foundation is provided by a rectangular panel having a flat upper face and downwardly depending side and end walls to form an open box-like structure. Downwardly facing mounting bores are provided at least at the corners of the foundation, and support legs are engaged in the bores to support the foundation at a spacing above a floor surface. The foundation is made entirely or substantially entirely from an expanded rigid plastic foam material with high flame retardancy. In an alternative, the side and end walls are eliminated and the legs are supported directly at the corners of a single flat panel, with springs tacked to the upper surface and surrounded by a suitable cover.

15 Claims, 3 Drawing Sheets

BED FOUNDATION

BACKGROUND OF THE INVENTION

The present invention relates to bed structures, and is particularly concerned with a bed foundation for supporting a mattress or the like.

A conventional bed or mattress support typically consists of a foundation unit or box spring unit placed on top of a metal bed frame having side rails, cross members, and legs. A typical box spring unit consists of a base having a wooden perimeter with wooden cross slats which are nailed, glued, or stapled together, metal spring units attached to the cross slats, and a suitable cover. The separate metal base frame and foundation unit are cumbersome and involve high labor costs in manufacture. Wood is also highly flammable and current construction methods are incapable of meeting new U.S. flammability standards.

Plastic bedding foundations to replace a conventional wood and metal foundation have been proposed in the past. U.S. Pat. No. 5,953,775 of Mauro et al. describes a foundation which has a top deck member, spaced side walls, and spaced end walls which may be formed integrally or separately out of plastic material by compression molding, injection molding, or thermo-forming. Patent Application Publication No. 2002/0069462 of Gaboury et al. describes a similar bed foundation made of blow-molded plastic. The foundation is made up from separate components which can be secured together without use of tools. This makes shipping easier and less expensive.

SUMMARY OF THE INVENTION

It is an object of the present invention to provide a new and improved bed foundation.

According to one aspect of the present invention, a bed foundation is provided, which comprises a rectangular top panel having opposite sides, opposite ends, and four corners, a pair of side panels depending downwardly from opposite sides of the top panel, and a pair of end panels depending downwardly from opposite ends of the panel to form a box-like enclosure having an open lower end, a corner support at each corner of the enclosure, each corner support having a lower face and a bore extending upwardly from the lower face of the corner support for receiving the end of a support leg for supporting the enclosure at a position raised above a floor surface, the panels and corner supports being of expanded rigid plastic foam material.

The box-like enclosure may be integrally formed in one piece, to form a uni-body foundation. Alternatively, the panels and corner supports may be formed separately and joined together by screw fasteners, adhesives or the like. One or more cross slats or braces of the same material as the panels may extend between the opposite side panels to provide additional strength, if necessary. Longitudinal cross braces may also be provided. The side and end panels may have openings or cut-outs of predetermined shape to reduce the amount of material required to manufacture the foundation and reduce overall weight, while still providing a sufficiently strong load-bearing structure. The openings may be of shapes such as elliptical, triangular, square or other shapes which have load-bearing properties, and there may be a single large opening in each panel or several spaced, smaller openings. Horizontal slots may be provided in one end panel for mounting of a conventional head board.

This arrangement therefore provides a single, open box shape foundation which can replace a previous bed frame and foundation or box spring combination, when plastic legs are inserted in the corner openings. Additional triangular supports with leg openings may be provided in the center of one or more cross slats, if provided, and may be desirable for larger size mattress foundations. The foundation is much simpler, lighter in weight, and less expensive than conventional bed foundations, and will have improved flame retardant properties.

Expanded rigid plastic foam has not been used in the bed foundation industry up to now, and is extremely strong while being relatively light in weight. In an exemplary embodiment of the invention, the foam was selected from the group consisting of phenolic, urethane, and poly-isocyanate rigid foam, of the closed cell variety, for its flame retardant properties. A bed foundation unit of this material will be rigid, strong, and light in weight, as well as exhibiting high flame retardant properties which will meet current U.S. federal standards.

According to another aspect of the present invention, a bed foundation is provided which comprises a rectangular panel of a closed cell, expanded rigid plastic foam material, the panel having four corners each having a lower face and a bore extending upwardly from the lower face for receiving a support leg for supporting the panel at a spacing above a floor surface. The panel is of predetermined dimensions based on the size of the mattress to be supported, and will be provided in different size to accommodate single, double, queen, king or other standard bed dimensions.

In one example, a plurality of springs are secured to the upper surface of the panel and enclosed in a suitable cover, so that the assembly including the legs will replace a conventional box spring and frame. The springs may be tacked onto the panel. The panel may be of uniform thickness with flat upper and lower faces, or may have recesses on its lower face or even cut-out openings to provide a format more similar to a conventional wooden slat box spring base, the springs being attached to the remaining panel material between the openings.

In another example, a mattress may be supported directly on top of the panel. The panel may be of two or more layers of different durometer ratings or flexibility, the lower layer being more rigid and the upper layer being a more flexible surface laminate, to provide a support surface with a flexible yield. The panel may have downwardly depending side walls and end walls to provide a box-like structure.

The bed foundation of this invention is made substantially or entirely of expanded rigid plastic foam material, which is exceptionally strong yet ultra light in weight. This material is also nearly inflammable, unlike a conventional bed foundation which includes wood components, and exceeds all proposed and current U.S. flammability standards for beds. The uni-body version requires no assembly tools and can be readily installed. All of the alternative versions are very inexpensive to produce and are of relatively simple construction, and completely eliminate current metal bed frames and separate box springs.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which.

DETAILED DESCRIPTION OF THE DRAWINGS

Figure 2:
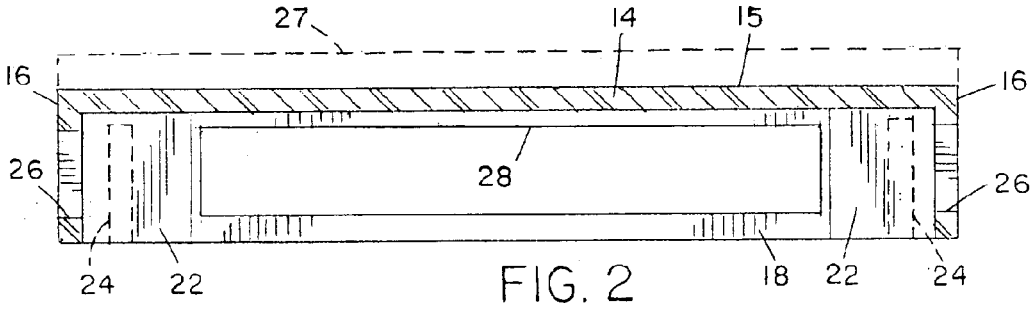
FIG. 2 is an enlarged sectional view taken on line 2—2 of FIG. 1.
Figure 3:
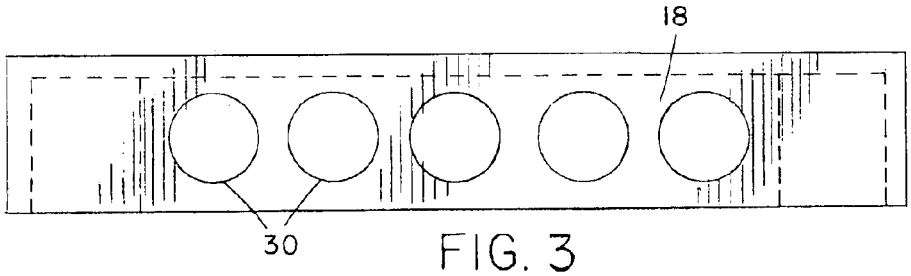
FIG. 3 is an end view of the bed foundation showing an alternative arrangement of the lightening cut outs.
Figure 4:
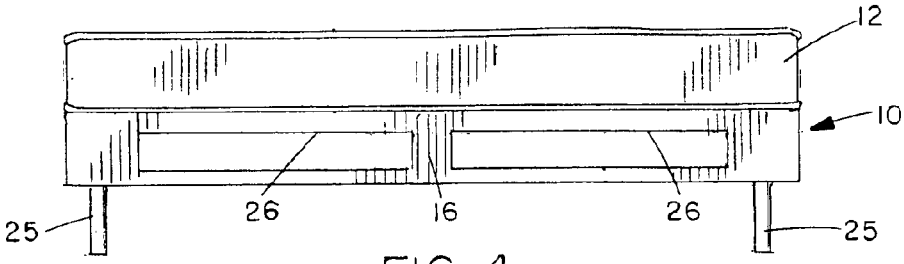
FIG. 4 is a side view of the bed foundation with support legs and a mattress or box spring added.

FIGS. 1 to 4 of the drawings illustrate a uni-body bed foundation unit 10 according to a first embodiment of the present invention, for supporting box spring and mattress, or a mattress 12 placed directly on top of unit 10 as indicated in FIG. 4. It will be understood that the unit will be made in a range of lengths and widths corresponding to the various standard mattress sizes, such as single or twin, full, queen, king, California king, and in both standard lengths and extra long lengths.

Figure 1:
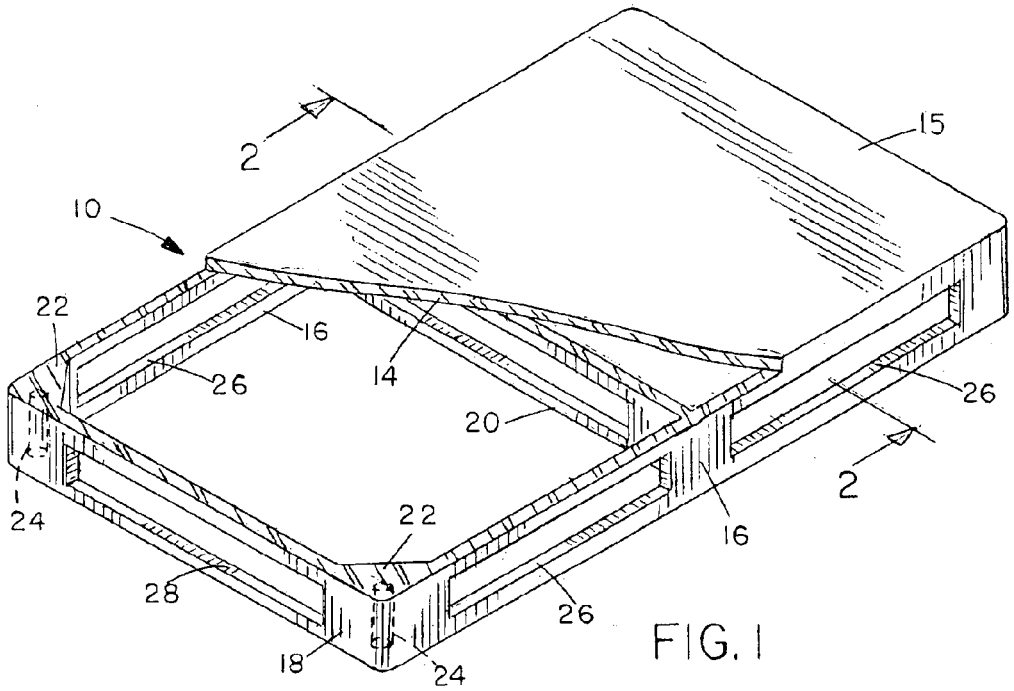
FIG. 1 is a perspective view, partially cut away, of an exemplary form of the bed foundation of this invention.

The unit 10 of FIGS. 1 and 2 is molded in one piece from an expanded rigid plastic foam material. This material is cold-poured into a suitably shaped mechanical mold. Expanded rigid plastic foam materials are extremely lightweight yet durable, strong, and flame retardant. In an exemplary embodiment the material was selected from the group consisting of phenolic, urethane and poly-isocyanate rigid foam of the closed cell variety, for flame retardancy, and may be of a rating (cell density) of 90% or more. The selected foam must have a compressive strength of around 103 PSI perpendicular and 106 PSI parallel, a shear strength of around 35 PSI perpendicular and 30 PSI parallel, and a shear modulus of 525 to 669 PSI. The density is in the range of 5 pounds per cubic foot to 15 pounds per cubic foot.

Unit 10 has a rectangular upper panel 14 which has a continuous, flat upper surface 15 for supporting a mattress 12 as in FIG. 4, or a conventional box spring with a mattress placed on top, if desired. Integral side walls 16 and end walls 18 depend downwardly from the opposite side edges and end edges of panel 14. This forms a box-like structure with a lower end opening. One or more integral cross slats 20 may extend between the opposite side walls 16 if required for additional strength. The unit also has integral, triangular corner blocks or bosses 22 at the four corners of the box-like structure. A mounting bore 24 extends upwardly from the lower face of each corner block 22, for receiving the end of a support leg 25 of the same material as unit 10. Support legs 25 are a press fit in the respective mounting bores.

For larger size mattresses, and thus larger size foundation units 10, one or more additional support legs may be provided along the sides and at the center of the or each cross slat 20, for example. In this case, triangular supports with leg mounting bores will be formed integrally at the center of a cross slat and/or at the junctions between cross slats and side walls. As noted above, a mattress may be placed directly on top of foundation unit 10, as indicated in FIG. 4, so that the unit replaces both a conventional metal bed frame and a conventional wood and metal box spring normally placed on a metal bed frame to provide a flexible support for the mattress. In this case, a non-flexible support surface for the mattress is provided. However, a flexible surface laminate 27 of the same material as unit 10 but lower density may be provided on top of the less flexible panel 14, as indicated in dotted outline in FIG. 2, to provide a support surface with a flexible yield, simulating a box spring structure. This provides a dual durometer layer construction for panel 14, comprising a lower layer of higher rigidity and an upper layer of higher flexibility. The two layers may be of substantially equal thickness or of different thicknesses.

Each side wall 16, end wall 18, and cross slat 20 (if present) has one or more openings or cut outs. In the embodiment illustrated in FIGS. 1 and 2, each side wall has two rectangular openings 26 and each end wall and cross slat has one rectangular opening 28 extending across the majority of its length. These openings have the purpose of reducing the amount of material required, and thus the overall weight and cost of the foundation unit, while not significantly reducing strength. Although the openings are relatively large, rectangular openings in this embodiment, they may be of other shapes and dimensions, such as a plurality of circular openings 30 as illustrated in FIG. 3, or of elliptical, square, polygonal, triangular, irregular or other shapes, or combinations of different shape openings. The overall effect is removal of 50% or more of the total material required for making a solid wall of corresponding dimensions having no openings.

As discussed above, foundation unit 10 may be manufactured by cold-pouring the selected expanded rigid plastic foam material into a mold with corresponding side wall openings and surface structure. This technique generates no scrap or trimming waste and is extremely efficient. Uni-body molding therefore allows the use of less material and produces an inherently strong, integral box-like structure. However, shipping costs may be relatively high due to the overall size of the units.

Figure 5:
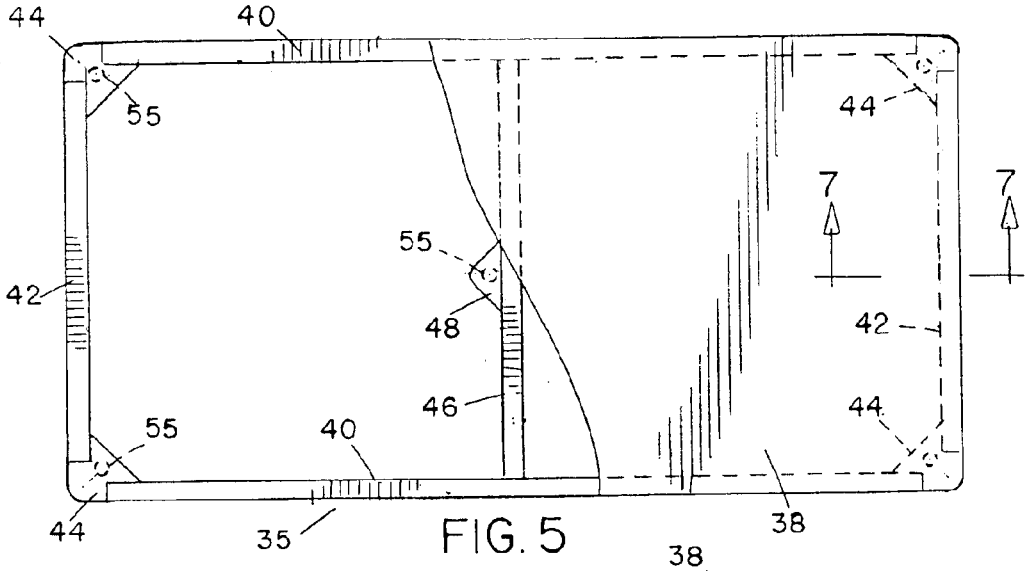
FIG. 5 is a top plan view, partially cut away, of an alternative knock down configuration of the bed foundation.
Figure 6:
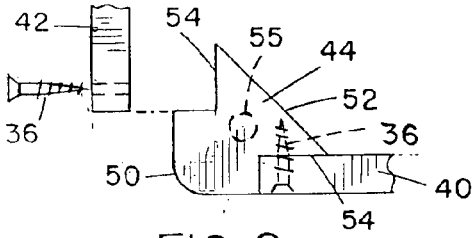
FIG. 6 is an enlarged view of one corner of the structure of FIG. 5.
Figure 7:
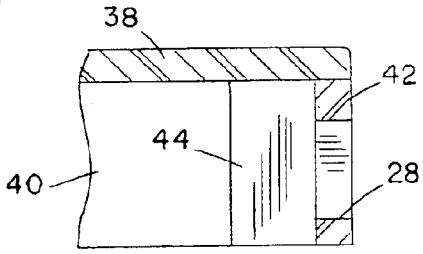
FIG. 7 is an enlarged sectional view taken on line 7—7 of FIG. 5.

FIGS. 5 to 7 illustrate an alternative, knock-down mattress foundation unit or foundation assembly 35. This unit is of similar structure to the one-piece or uni-body unit 10, but is made in several separate generally flat parts which can be secured together by suitable fasteners such as screws 36. The parts comprise at least a flat upper panel 38, a pair of side walls 40, a pair of end walls 42, and four corner blocks or bosses 44 forming both the corner and the leg mounting boss at each corner of the unit 35. For larger size mattresses, the knock-down unit also comprises one or more cross slats 46, and optionally one or more separate, triangular leg mounting units or bosses 48. The side walls, end walls, and cross slat (if present) will all have openings or cut-outs of any desired shape or combination of shapes, such as rectangular cut-outs 26,28 as illustrated in the first embodiment. This will reduce the overall weight of the assembly.

Each part of the foundation assembly 35 is made of the same expanded rigid plastic foam material as the uni-body foundation unit 10 of the previous embodiment. However, since each part other than the corner pieces or leg mounting bosses is a flat panel, no mold is required and the parts may be simply cut from a bun to the appropriate dimensions. The material should be of a higher density, suitably not less than 12 pounds per cubic foot, to enable fastening of the parts with screws 36 and/or adhesives. The thickness of the side and end panels will also be greater in this embodiment than the unibody version, to provide an adequate anchor for the fasteners. The corner pieces will be molded in a suitable mechanical mold of corresponding shape and dimensions.

As best illustrated in FIG. 6, each corner block 44 is generally triangular in shape, with a rounded outer corner 50, a flat, slanted inner face 52, and cut-outs or recesses 54 on each side for receiving the end of the respective end wall 42 and side wall 40. A leg mounting bore 55 extends upwardly from the lower face of each block 44 for receiving legs 25 in exactly the same manner as illustrated in the first embodiment. When the walls 40,42 are properly engaged in the respective recesses 54, they are secured in position with fastener screws 36 as indicated. These may be Phillips head tec screws or equivalent fasteners. Alternatively, or additionally, spray adhesives may be used to secure the parts together. The upper panel 38 is also secured to the side walls by similar fasteners (not illustrated). The central leg mounting block 48 is a simple triangular block which also has a leg mounting bore 55 and is secured to the cross slat 46 by a screw and/or adhesive.

The advantage of the knock down assembly over the uni-body foundation unit 10 of the first embodiment is that shipping costs will be lower, since the parts can be shipped prior to assembly in a relatively small box, and then assembled on site quickly and easily using only basic hand tools. Once assembled, the joint lines in the knock down assembly will be nearly invisible, due to the compression fit between the parts. The uni-body construction has the advantage of requiring no assembly on site, but will require larger storage space prior to installation and will be more expensive to ship. In both cases, the product is made entirely or almost entirely of expanded rigid plastic foam material (apart from the fastener screws in the case of the knock down version). This material is extremely strong, offering in excess of five times the strength of comparable wood products, is nearly inflammable, and is very light in weight. The foundation is very inexpensive to produce, and completely eliminates the current unattractive and heavy metal bed frame or bed frame and box spring combination, replacing these parts with a single support unit and legs.

The side and end walls or panels in each of the above embodiments will have at thickness in the range of 0.25 to 2.00 inches, with the side and end walls being thicker in the knock down version to anchor the fasteners. The top panel thickness will be in the range of 0.125 to 2.00 inches, again being thicker in the knock down version. As noted above, the density will also be higher in the knock down version, for the same reason. The height of the side and end walls is at least 1 inch, and may be higher than this if desired, based on the desired overall bed height. The length and width of the top panel will be variable depending on the width and length of the mattress to be supported.

Figure 8:
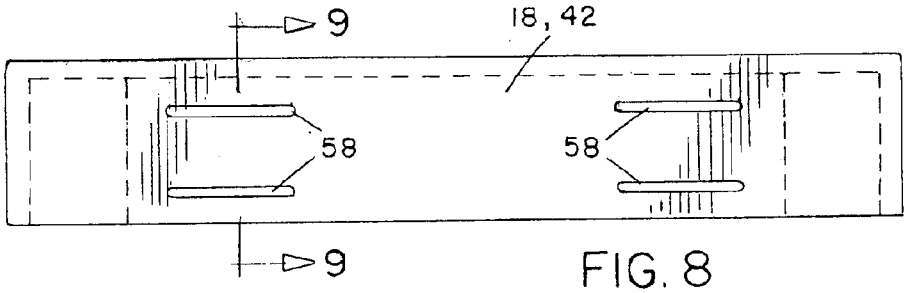
FIG. 8 is an end view similar to FIG. 3, but showing means for attachment of the headboard.
Figure 9:
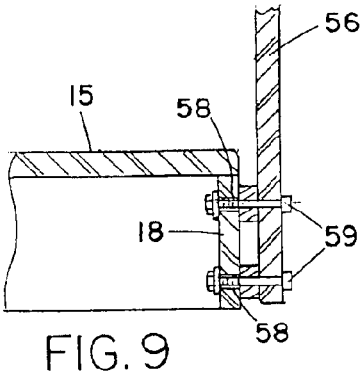
FIG. 9 is a sectional view taken on line 9—9 of FIG. 8, with a headboard secured in place.

FIGS. 8 and 9 illustrate an optional modification of one end wall 18 or 42 of the foundation unit to allow mounting of a headboard 56. End wall 18 or 42 is provided with two spaced pairs of parallel, horizontal slots 58. The lower end of a headboard 56 is secured to the end wall of the foundation unit via nut and bolt fasteners 59 extending through the slots and aligned openings in the headboard, as illustrated in FIG. 9.

In both of the above embodiments, the foundation unit has the general shape of a rectangular box, open at the bottom, with all four corners radiused to the industry standard. On larger units, typically queen size or larger, one or more transverse cross braces may be used, depending on the sleep surface load requirements. If necessary, longitudinal braces may be installed between the end walls for additional strength. The corner units or bosses have mounting bores for the plastic support legs 25, thus eliminating the need for a separate bed frame and further reducing cost and weight.

Figure 10:
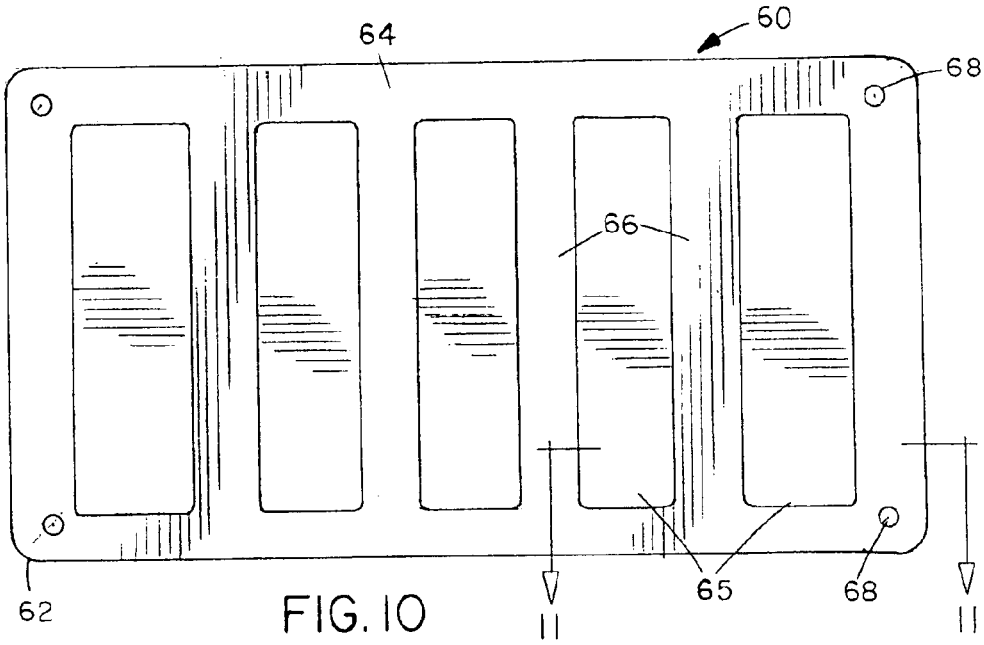
FIG. 10 is a top plan view of a box spring base unit according to another embodiment of the invention.
Figure 11:
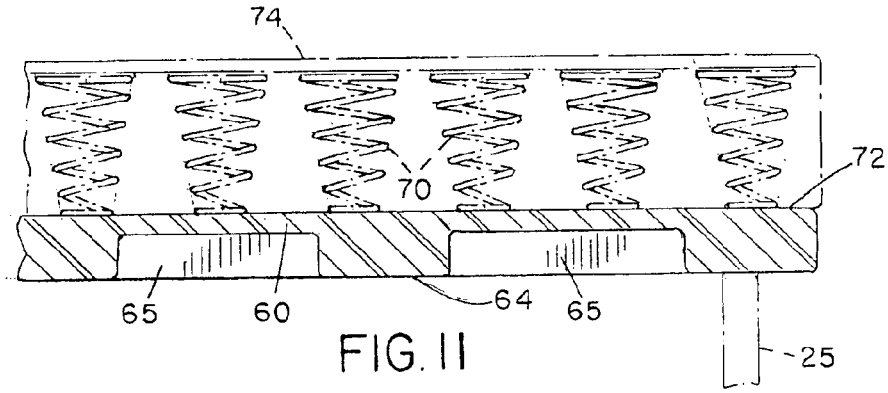
FIG. 11 is an enlarged sectional view taken on line 11 of FIG. 10, with box springs and a cover indicated in broken line.
Figure 12:
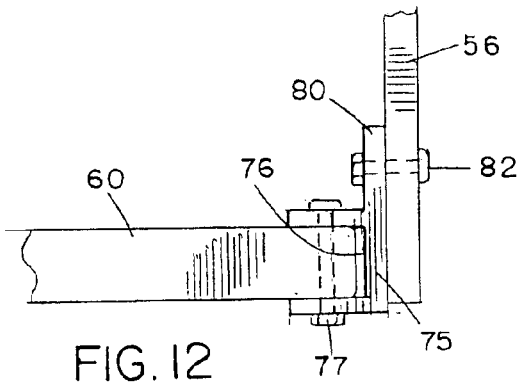
FIG. 12 is a side view of one end of the base of FIG. 10 with a headboard attached.

FIGS. 10 to 12 illustrate a box spring base unit or panel 60 according to another embodiment of the invention, for replacing a conventional wood slat box spring base as well as the metal frame which would normally support a conventional box spring unit. Unit 60 basically comprises a flat, rectangular panel with radiused corners 62. The lower surface 64 of the panel may have rectangular recesses 65 extending across a major portion of its width, as indicated in FIGS. 10 and 11, to reduce overall weight. This also produces a shape similar to that of a conventional wood slat box spring, with the strips or portions 66 of material between the recesses corresponding in position to the conventional wood slat. The recesses may be replaced with openings extending through the entire thickness of the panel, if desired. However, a solid panel will exhibit better flame retardancy.

The panel or unit 60 will be made of the same expanded rigid plastic foam material as the foundation units of the previous embodiments, and may be made by cutting a bun slice of the foam material of the appropriate thickness, or by molding. The foam material selected may have a density of the order of fifteen pounds per cubic foot. Downwardly facing leg mounting bores 68 are provided at each corner for receiving the end of plastic support legs 25, avoiding the need for a separate metal bed frame.

In order to complete the box spring unit, metal box springs 70 are tacked onto the upper surface 72 of the panel, as illustrated in FIG. 11, and a suitable cover 74 is placed over the box springs. The springs may be attached only around the periphery of the recesses and along the strips 66 between adjacent recesses, if desired. A mattress may then be placed on top of cover 74. A solid panel with no openings has the advantage of higher flame retardancy, since it will prevent flames from beneath the bed from penetrating to the burnable materials typically used to enclose the box springs.

FIG. 12 illustrates a headboard mounting bracket 75 for use with the box spring flat or unit 60. Bracket 75 has a channel or groove 76 for engaging over an end of the panel or unit 60. Bracket 75 is secured to the panel 60 via bolts 77, and has an upright mounting flange 80 for attachment to the lower end of the headboard 56 via bolts 82 which extend through a slot in flange 80. The bracket 75 may be made of the same lightweight and flame retardant foam material as the box spring flat 60.

The panel 60 may have a thickness of the order of 0.125 to 2.00 inches to provide adequate supporting strength for the box spring and mattress. The cross brace width, or width of portions 66 between adjacent recesses or openings, should be at least six inches to provide an adequate base for the attached row of springs.

In each of the above embodiments, a conventional metal bed frame and box unit or box spring is replaced by a simple, lightweight unit or assembly of flame retardant, expanded rigid plastic foam material. In the first two units, the foundation is of a box-like shape with an open base, with corner pieces for receiving plastic legs, and the mattress is placed directly on top of the upper panel of the unit. In the third embodiment, the foundation is a flat panel for replacing a conventional box spring base or flat, with corner openings for receiving plastic legs, and with box springs stapled to the upper surface of the panel with a suitable surrounding enclosure. The material chosen for the bed foundation of this invention is a considerable improvement over conventional bed frame and box spring construction materials, with much higher flame retardancy, lighter weight, reduced complexity, yet equivalent or better strength and durability. This invention completely eliminates the need for a separate metal bed frame.

Although some exemplary embodiments of the invention have been described above by way of example only, it will be understood by those skilled in the field that modifications may be made to the disclosed embodiments without departing from the scope of the invention, which is defined by the appended claims.

I claim:

1. A bed foundation, comprising:

a rectangular top panel having opposite sides, opposite ends, and four corners;

a pair of side panels and a pair of end panels depending downwardly from opposite sides and ends of the top panel, respectively, to form a box-like enclosure having an open lower end;

a corner support at each corner of the enclosure, each corner support having a lower face and a bore extending upwardly from the lower face of the corner support for receiving the end of a support leg for supporting the enclosure at a position raised above a floor surface;

the panels and corner supports being of expanded rigid plastic foam material and the top panel, side panels and end panels being formed integrally in one piece; and one end panel having horizontal slots for mounting of a head board.

2. A bed foundation, comprising:

a rectangular top panel having opposite sides, opposite ends, and four corners;

a pair of side panels and a pair of end panels depending downwardly from opposite sides and ends of the top panel, respectively;

the top panel, side panels and end panels together forming a box-like enclosure having an open lower end;

the enclosure being formed entirely of expanded rigid plastic foam material; and the top panel having a lower layer of the same foam material as the side and end panels, the lower layer being of a first flexibility, and an upper layer, the upper layer comprising an expanded rigid plastic foam material layer of a second flexibility greater than said first flexibility.

3. The foundation as claimed in claim 2, wherein the top panel, side panels, end panels and corner supports are formed integrally in one piece.

4. The foundation as claimed in claim 2, wherein the top panel, side panels, end panels and corner supports are formed separately.

5. The foundation as claimed in claim 4, including securing devices for securing the top, side and end panels and corner supports together to form said box-like enclosure.

6. The foundation as claimed in claim 3, wherein the side panels each have at least one opening.

7. The foundation as claimed in claim 6, wherein the openings are rectangular.

8. The foundation as claimed in claim 6, wherein the openings are circular.

9. The foundation as claimed in claim 6, wherein the openings extend over at least 50% of the total surface area of the respective panel.

10. The foundation as claimed in claim 2, wherein at least one cross brace extends between the side panels.

11. The foundation as claimed in claim 10, including a leg mounting block secured to said cross brace, the leg mounting block having a downwardly facing mounting bore for mounting an additional support leg.

12. The foundation as claimed in claim 2, wherein;

the expanded rigid plastic foam material is selected from the group consisting of phenolic, urethane, and polyisocyanate rigid foam.

13. The foundation as claimed in claim 12, wherein the foam is of the closed cell variety.

14. The foundation as claimed in claim 2, wherein;

the foam has a density in the range from 5 to 20 pounds per cubic foot.

15. The foundation as claimed in claim 2, wherein the foam is of the closed cell variety.

* * * * *